United States Patent [19]

Edgcombe

[11] 4,100,457

[45] Jul. 11, 1978

[54] VELOCITY MODULATION TUBES EMPLOYING HARMONIC BUNCHING

[75] Inventor: Christopher John Edgcombe, Coton, England

[73] Assignee: English Electric Valve Company Limited, England

[21] Appl. No.: 749,989

[22] Filed: Dec. 13, 1976

[30] Foreign Application Priority Data

Dec. 13, 1975 [GB] United Kingdom ..... 51164/75

[51] Int. Cl.[2] ..... H01J 23/20

[52] U.S. Cl. ..... 315/5.51; 315/5.39; 315/5.52

[58] Field of Search ..... 315/5.51, 5.52, 5.39

[56] References Cited

U.S. PATENT DOCUMENTS

| | | | |
|---|---|---|---|
| 3,622,834 | 11/1971 | Lien | 315/5.51 |
| 3,811,065 | 5/1974 | Lien | 315/5.51 |
| 3,819,977 | 6/1964 | Kageyama | 315/5.51 |
| 3,902,098 | 8/1975 | Tanaka et al. | 315/5.51 |
| 3,974,417 | 8/1976 | Kageyama et al. | 315/5.52 |

*Primary Examiner*—Saxfield Chatmon, Jr.

[57] ABSTRACT

A klystron tube is provided with a long drift tube between the last prebuncher interaction gap and the first buncher interaction gap. The length of the long drift tube is such that in a preferred embodiment the ratio of the peak R.F. gap voltage to the D.C. beam voltage is between 1.4 × Wq/w and 2Wq/w where Wq is the reduced plasma frequency in radians per second and $w = 2\pi \times$ signal frequency. By this means the distribution of the electrons in the beam is improved.

3 Claims, 1 Drawing Figure

VELOCITY MODULATION TUBES EMPLOYING HARMONIC BUNCHING

Figure 3:
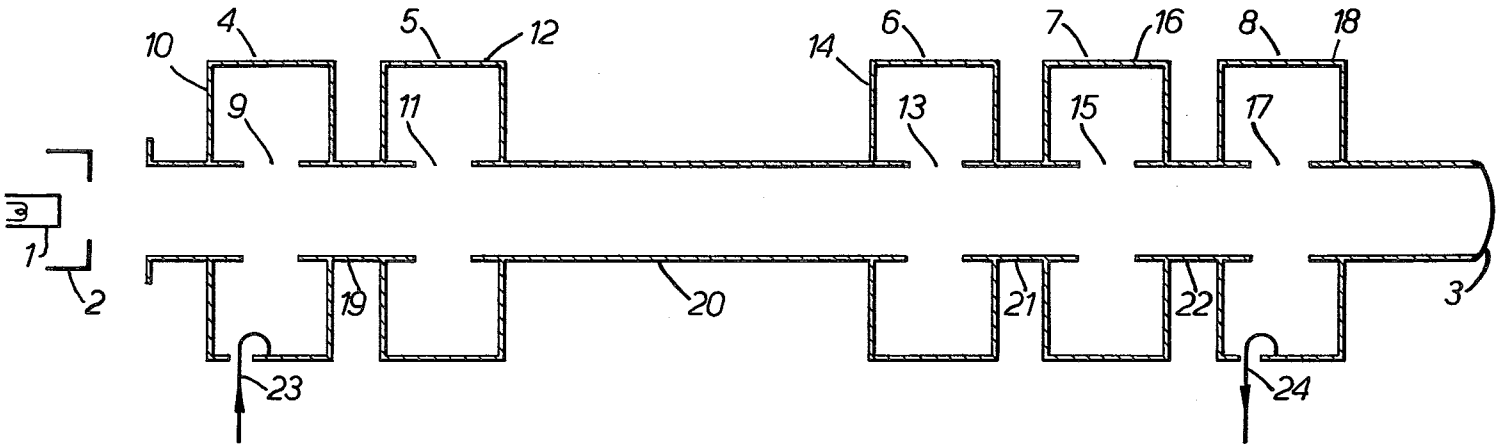

This invention relates to velocity modulation tubes or klystron tubes as they are commonly called.

The usual form of klystron tube consists of a cathode which projects a stream of electrons past a modulating anode and through a series of drift tubes separating interaction gaps which are surrounded by resonant cavities (of the internal or external type). A collector electrode is provided down stream of the interaction gaps. Means are provided for injecting radio frequency energy into the resonant cavity nearest the cathode and means are provided for extracting modulated radio frequency energy from the resonant cavity furthest from the cathode.

It is known to provide one or more of the resonator systems, each consisting of a gap surrounded by a cavity, as prebuncher systems which act to velocity modulate the electron stream with a second harmonic voltage of the signal being amplified in order to render the distribution of electrons in the beam more favourable for action by subsequent bunching resonator systems at the collector end of the tube. It is also known to provide the drift tube between the, or the last of the, prebuncher resonant systems and the first of the buncher resonator systems to be longer than the average length of drift tube in order to achieve the improved efficiency offered by the use of prebuncher resonant systems, whilst avoiding the severe bandwidth limitation which such prebuncher systems otherwise impose. Generally speaking the long drift tube before the first of the buncher resonant systems has a length such that the reduced plasma drift angle $\theta$ between the centres of the two interaction gaps on either side of the tube is greater than 90°.

The reduced plasma drift angle $\theta$ referred to above is defined as:

$$\theta = 360/2\pi \times Wq/v \times l$$

where $Wq$ is the reduced plasma frequency in radians per second $v$ is the d.c. beam velocity and $l$ is the length of the drift tube between the centres of said two gaps.

The reduced plasma frequency $Wq$ is defined as:

$$Wq = Wp \times F$$

where $Wp$ is the electron plasma frequency in the beam and $F$ is the plasma reduction factor.

Both $Wp$ and $F$ are well known parameters in the art. The former depends upon the beam perveance (that is to say the ratio of $i_b$ to $v_{b\,3/2}$ where $i_b$ is the beam current and $v_b$ is the beam voltage). The latter depends upon the nature of the focusing system used and the geometry of the beam and drift tube.

The present invention seeks to provide an improved velocity modulation tube utilising a long drift tube between the interaction gap of a prebuncher resonator system and the interaction gap of a following buncher resonator system in which the subsequent distribution of the electrons in the beam is improved.

According to this invention a velocity modulation tube having a long drift tube between the interaction gap of a prebuncher resonator system and the interaction gap of a buncher resonator system is provided wherein for at least said first mentioned gap the ratio $\alpha$ of the peak r.f. gap voltage to the d.c. beam voltage is arranged to lie between a lower value at which the subsequent charge density distribution in the beam becomes sinusoidal and a higher value at which overtaking of one or more electrons by others in the beam occurs to such an extent that efficiency is unduly impaired.

Preferably the higher value of $\alpha$ is approximately $2Wq/w$ where $Wq$ is the reduced plasma frequency in radians per second, as hereinbefore defined, and $w$ equals $2\pi \times$ the signal frequency.

Preferably the lower value for $\alpha$ is approximately 70% of the higher value for $\alpha$ that is to say approximately $1.4 \times Wq/w$.

Typically, for a tube of beam perveance equal to 2, the range of values of $\alpha$ used in practice for the gap before the long drift tube, will be from 0.18 to 0.26.

The invention is illustrated in and further described with reference to the accompanying drawing which illustrates in schematic manner one klystron velocity modulation tube in accordance with the present invention.

Referring to the drawing, a cathode 1 is provided to project a stream of electrons past a modulating anode 2 to a collector electrode 3 situated at the opposite end of the tube. Between the cathode 1 and the collector electrode 3, two prebuncher resonator systems 4 and 5 and three buncher resonator systems 6, 7 and 8 are provided.

Resonator system 4 consists of an interaction gap 9 surrounded by a cavity 10. Resonator system 5 consists of an interaction gap 11 surrounded by a cavity 12. Resonator system 6 consists of an interaction gap 13 surrounded by cavity 14. Resonator system 7 consists of an interaction gap 15 surrounded by a cavity 16. Resonator system 8 consists of an interaction gap 17 surrounded by a cavity 18. Between interaction gaps 9 and 11; 11 and 13; 13 and 15 and 15 and 17 are drift tubes referenced 19, 20, 21 and 22 respectively.

The tube illustrated is of the integral cavity type and an r.f. transmission line 23 is shown coupled to cavity 10, whereby r.f. input may be applied to the tube, and an r.f. transmission line 24 is shown extending out of cavity 18 whereby modulated r.f. energy may be taken out of the tube.

Drift tube 20 between the last (referenced 5) of the prebuncher resonator systems and the first (referenced 6) of the buncher resonator systems has a length longer than the other drift tubes 19, 21 and 22. The length of this drift tube 20 is such as to provide a reduced plasma drift angle, as hereinbefore defined, of greater than 90°. In addition, for the interaction gap 11 in the last of the prebuncher resonator systems the ratio $\alpha$ of the peak r.f. gap voltage to the d.c. beam voltage is arranged to be between $1.4 \times Wq/w$. and $2.0 \times Wq/w$. For a beam perveance of 2, this provides a range of values for $\alpha$ between 0.18 and 0.26.

The structure illustrated in the drawing is, of course, enclosed within an envelope (not shown).

The invention is not limited to the use of any particular number of buncher resonator systems or prebuncher resonator systems. For example, commonly there will be but one single prebuncher resonator system.

The optimum value of $\alpha$ is related in any particular case to the beam perveance that is to say the ratio of $i_b$ to $v_{b\,3/2}$, where $i_b$ is the beam current and $v_b$ is the beam voltage. The lower the perveance, the smaller the repulsion between neighbouring electrons and the less the modulation required to achieve a given degree of bunching.

It has been found that the value of $\alpha$ for which overtaking of one or more electrons in the beam by others just begins is approximately $\alpha = 2Wq/w$ where $w$ equals $2\pi \times$ the signal frequency and $Wq$ is the reduced plasma frequency as hereinbefore defined. $Wq/w$ is in fact approximately proportional to the square root of the beam perveance. This sets the approximate upper limit to the desired range of $\alpha$. The lower limit at which the subsequent charge density distribution becomes sinusoidal is in general 70% to 80% of the higher value of $\alpha$ in the range.

I claim:

1. A velocity modulation tube having a drift space between at least one pre-buncher resonator system and at least one buncher resonator system, in which the length of said drift space is dimensioned so that the reduced plasma drift angle between the interaction gap in the last pre-buncher resonator system and the interaction gap in the first buncher resonator system is greater than 90°, and wherein at least at said interaction gap in said last pre-buncher resonator system the ratio of the peak value of the radio frequency voltage occurring at said interaction gap to the d.c. beam voltage lies in the range between approximately $2Wq/w$ and approximately $1.4Wq/w$ wherein $Wq$ is the reduced angular plasma frequency and $w$ is the angular signal frequency.

2. A tube as claimed in claim 1 and of beam perveance equal to 2 and wherein the range of values of $\alpha$ used in practice for the gap before the long drift tube, will be from 0.18 to 0.26.

3. In a velocity modulation tube having electron gun means at one end of the tube for projecting a beam of electrons at predetermined d.c. beam voltage, a collector electrode at the opposite end of the tube, means adjacent said one end of the tube for velocity modulating said beam with r.f. energy, means adjacent said opposite end of the tube for extracting amplified r.f. energy from said beam, prebuncher resonator means disposed between the ends of said tube and having an interaction gap for current density modulating said beam with a second harmonic voltage of said r.f. energy, buncher resonator means disposed between said prebuncher resonator means and said collector electrode and having an interaction gap for further current density modulating said beam, and a drift tube extending between said interaction gaps, said drift tube being of a length to provide a reduced plasma drift angle between the centers of said interaction gaps which is greater than 90°, the improvement wherein:

said tube is detailed in design such that the ratio $\alpha$ of the peak r.f. gap voltage occurring at said interaction gap of the prebuncher means to said d.c. beam voltage lies in the range between approximately $2Wq/w$ and approximately $1.4Wq/w$ where $Wq$ is the reduced plasma frequency and $w$ is the angular frequency of said r.f. energy.

* * * * *